US005235322A

United States Patent [19]

Obysovsky et al.

[11] Patent Number: 5,235,322

[45] Date of Patent: Aug. 10, 1993

[54] PERSONAL PROTECTION SYSTEM

[76] Inventors: Martin Obysovsky, 264 W. 22nd St. #3B, New York, N.Y. 10011; George Spector, 233 Broadway Rm 3815, New York, N.Y. 10007

[21] Appl. No.: 748,820

[22] Filed: Aug. 22, 1991

[51] Int. Cl.[5] ..... G08B 15/00

[52] U.S. Cl. ..... 340/574; 340/573

[58] Field of Search ..... 340/574, 573

[56] References Cited

U.S. PATENT DOCUMENTS 4,694,284 9/1987 Leveille et al. ..... 340/573

4,788,532 11/1988 Maldonado ..... 340/574

*Primary Examiner*—Glen R. Swann, III

[57] ABSTRACT

A personal protection system is provided, which consists of a band to be worn around a wrist of a person. A first mechanism is for producing an audio signal and is disposed in the band. A second mechanism is for powering the first audio signal producing mechanism and is disposed in the band. A third mechanism is for manually activating the second powering mechanism and is disposed in the band. A fourth mechanism is for keeping the band closed around the wrist of the person and is disposed in the band. A fifth mechanism is for manually deactivating the third manually activating mechanism and for opening the fourth band closing mechanism simultaneously.

3 Claims, 1 Drawing Sheet

PERSONAL PROTECTION SYSTEM

BACKGROUND OF THE INVENTION

The instant invention relates generally to emergency signalling devices and more specifically it relates to a personal protection system which provides a mechanism worn on a person to produce an audible alarm.

There are available various conventional emergency signalling devices which do not provide the novel improvements of the invention herein disclosed.

SUMMARY OF THE INVENTION

A primary object of the present invention is to provide a personal protection system that will overcome the shortcomings of the prior art devices.

Another object is to provide a personal protection system worn on a person that contains a mechanism which may be manually triggered to produce an audible alarm so as to prevent an abduction or mugging of the person.

An additional object is to provide a personal protection system when worn on the person and activated cannot be removed and deactivated without the use of a special key.

A further object is to provide a personal protection system that is simple and easy to use.

A still further object is to provide a personal protection system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
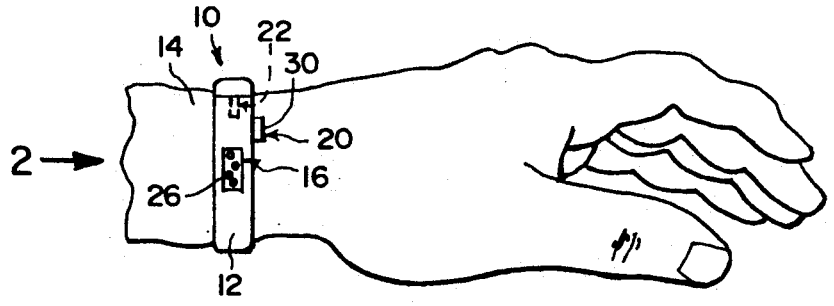
FIG. 1 is a perspective view of the instant invention worn around a wrist of a person.
Figure 2:
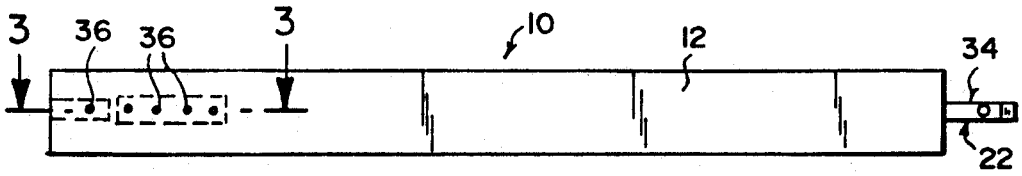
FIG. 2 is an end view taken in direction of arrow 2 in FIG. 1, with the band shown opened.
Figure 3:
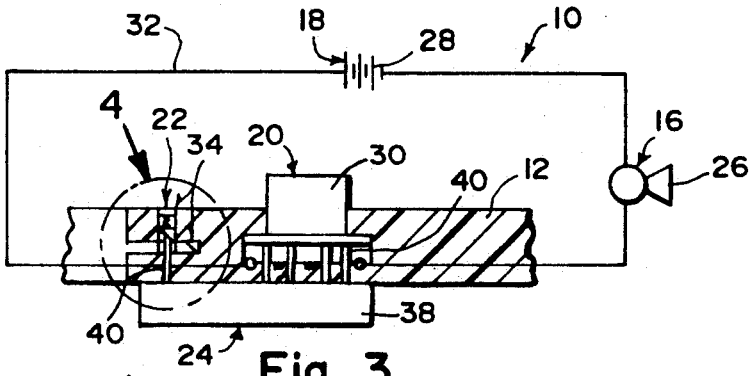
FIG. 3 is a cross sectional view taken along line 3—3 in FIG. 2, with the band closed, the key inserted and showing the electrical circuit in schematic form.
Figure 4:
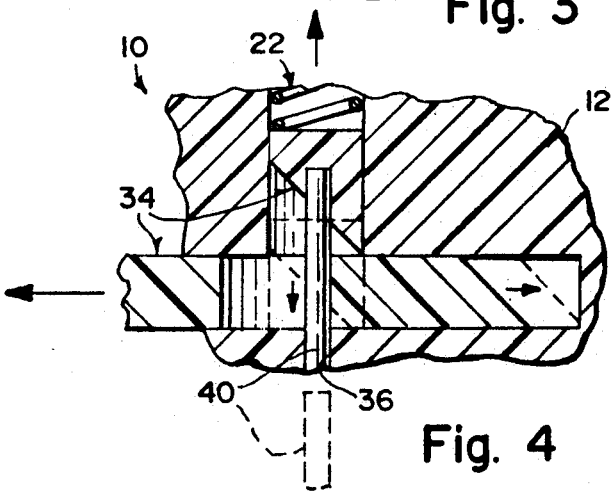
FIG. 4 is an enlarged sectional view as indicated by arrow 4 in FIG. 3, showing the projection and retainer latch assembly in greater detail.
Figure 3A:
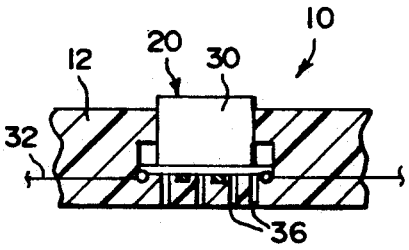
FIG. 3A is a cross sectional view similar to the cross sectional view portion of FIG. 3, showing the push button of the switch depressed therein against the magnets.

Turning now descriptively to the drawings, in which similar reference characters denote similar elements throughout the several views, the Figures illustrate a personal protection system 10, which consists of a band 12 to be worn around a wrist 14 of a person. A first mechanism 16 is for producing an audio signal and is disposed in the band 12. A second mechanism 18 is for powering the first audio signal producing mechanism 16 and is disposed in the band 12. A third mechanism 20 is for manually activating the second powering mechanism 18 and is disposed in the band 12. A fourth mechanism 22 is for keeping the band 12 closed around the wrist 14 of the person, which is disposed in the band 12. A fifth mechanism 24 is for manually deactivating the third manually activating mechanism 20 and for opening the fourth band closing mechanism 22 simultaneously.

The first audio signal producing mechanism 16 includes an audible alarm 26. The second powering mechanism 18 includes a battery 28. The third power manually activating mechanism 20 includes a push button magnetic switch 30 to close an electric circuit 32 connecting the battery 28 to the audible alarm 26. The fourth band closing mechanism 22 includes a projection and retainer latch assembly 34.

The fifth manually deactivating and band opening mechanism 24 includes the band 12 having a plurality of apertures 36, in which one extends into the projection and retainer latch assembly 34, while the others extend into the bottom of the push button magnetic switch 30. A key 38 is provided and has a plurality of prongs 40, which are insertable into the apertures 36 in the band 12. One prong 40 will enter into the one aperture 36 in the projection and retainer latch assembly 34 to open the band 12, while the other prongs 40 will enter into the other apertures 36 to open the push button magnetic switch 30, thereby opening the electric circuit 32.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A personal protection system which comprises:
   a) a band to be worn around a wrist of a person;
   b) means for producing an audio signal disposed in said band;
   c) means for powering said audio signal producing means disposed in said band;
   d) means for manually activating said powering means deposed in said band;
   e) mans for keeping said band closed around the wrist of the person disposed in said band; and
   f) means for manually deactivating said manual activating means and for opening said band closing means simultaneously.

2. A personal protection system as recited in claim 1, wherein said band closing means includes a projection and retainer latch assembly and said manual activating means is a push button switch.

3. A personal protection system as recited in claim 2, wherein said manual deactivating and band opening means includes:
   a) said band having a plurality of apertures, of which one extends into said projection and retainer latch assembly, while the others extend into the bottom of said push button magnetic switch; and
   b) a key having a plurality of prongs which are insertable into the apertures in said band, so that one prong will enter into the one aperture in said projection and retainer latch assembly to open said band, while the other prongs will enter into the other apertures to open said push button magnetic switch, thereby opening the electric circuit.

* * * * *